US006045860A

United States Patent [19]

Ito et al.

[11] Patent Number: 6,045,860

[45] **Date of Patent: *Apr. 4, 2000**

[54] PROCESS FOR MANUFACTURING INTERIOR TINNED COPPER TUBE

[75] Inventors: Junichi Ito; Tetsuro Atsumi; Makoto Yonemitsu; Yoshihiro Nishimoto; Hiroshi Okamura, all of Tokyo, Japan

[73] Assignee: Sumitomo Light Metal Industries, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/000,091

[22] PCT Filed: May 22, 1997

[86] PCT No.: PCT/JP97/01752

§ 371 Date: Jan. 16, 1998

§ 102(e) Date: Jan. 16, 1998

[87] PCT Pub. No.: WO97/46732

PCT Pub. Date: Dec. 11, 1997

[30] Foreign Application Priority Data

Jun. 5, 1996 [JP] Japan ..... 8-165397
Jun. 27, 1996 [JP] Japan ..... 8-188699

[51] Int. Cl.[7] ..... B05D 7/22

[52] U.S. Cl. ..... 427/232; 427/234; 427/235; 427/239; 427/437; 427/443.1

[58] Field of Search ..... 427/232, 234, 427/235, 239, 437, 443.1; 106/1.22, 1.25

[56] References Cited

U.S. PATENT DOCUMENTS 4,511,403 4/1985 Orio et al. ..... 106/1.22
5,266,103 11/1993 Uchida et al. ..... 106/1.22

FOREIGN PATENT DOCUMENTS 339741 12/1993 Japan .
127877 5/1996 Japan .

*Primary Examiner*—Brian K. Talbot
*Attorney, Agent, or Firm*—Flynn, Thiel, Boutell & Tanis, P.C.

[57] ABSTRACT

A process for manufacturing a copper tube with a tinned inner surface by circulating a substitution-type electroless tin plating solution inside the copper tube. The process is characterized by comprising a first plating step wherein the rate of deposition of a tin film is adjusted so that the total copper ion concentration in the plating solution, immediately after flowing from the copper tube, after having been circulated inside the tube divided by the tin (II) ion concentration in this plating solution is 0.8 or less, and a second plating step wherein plating is carried out at a plating solution temperature higher than the plating solution temperature in the first plating step. A plating solution comprising 0.05–0.3 mol/l of $Sn^2$ ion, 0.5–2.0 mol/l of thiourea, 0.5–2.0 mol/l of sulfuric acid, 0.05–2.0 mol/l of alkyl benzene sulfonic acid, and 0.5–5.0 g/l of a nonionic surface active agent is preferably used. The process ensures manufacture of long coiled tubes with tinned internal surface which are used as water supply tubes, hot water supply tubes, and tubes in heat exchangers. The tin plate film has a uniform thickness and exhibits superior adhesion properties and corrosion resistance.

9 Claims, No Drawings

PROCESS FOR MANUFACTURING INTERIOR TINNED COPPER TUBE

BACKGROUND OF THE INVENTION

1. Field of the Invention

The present invention relates to a process for manufacturing corrosion resistant copper tubes with the interior surface tinned which are used as water supply tubes, hot water supply tubes, tubes in heat exchangers, and the like, and, more particularly, to a process for manufacturing interior tinned long copper tubes in which the plated tin films have no defects and are highly corrosion resistant.

2. Description of the Background Art

Plating tin films inside copper tubes which are used as water supply tubes, hot water supply tubes, tubes in heat exchangers, and the like, to improve corrosion resistance and to prevent elution of copper ions from the tubes, is well known in the art. In particular, a process for causing a substitution type electroless tinning solution to flow through the inside of a copper tube has been proposed as a method for forming tinned films inside a long coil of copper tube (Japanese Patent Application Laid-open No. 45282/1992)

This method is very simple and efficient for processing a long coil of copper tube and produces thin tinned films with superior adhesive properties. However, when the products are used for a long period of time, elution of copper ions from the products due to wear and peeling of tinned films is detected. A method of subjecting tinned films to an oxidization treatment with hot water or steam to improve corrosion resistance has also been proposed (Japanese Patent Application Laid-open No. 99180/1992). However, the tinned film formed by this method also produces pitted corrosion when used under severe conditions. Generally, the corrosion resistance of a long copper tube tends to be insufficient, because it is difficult to form a uniform tinned film over the entire surface of a long copper tube. Improvement in the corrosion resistance in such a long copper tube has therefore been desired.

Another process which has been proposed for forming uniform plated films without defects and for improving pitted corrosion resistance or the like comprises controlling the ratio of the copper ion concentration and the tin ion concentration (copper ion concentration/tin ion concentration) in the plating bath to 0.7 to less, when tinning is carried out by dipping a copper plate in a plating bath or by circulating a plating solution inside a short copper tube with a length of several meters or less (Japanese Patent Application Laid-open No. 339741/1993). In this method, a uniform plating filmis produced by controlling the performance of the plating solution by supplying a fresh plating solution or adding chemicals such as a tin salt when the performance of the plating solution decreases.

However, because it takes a long time for the plating solution to be circulated in a long coil of copper tube with a length of from about thousand meters to a thousand and several hundred meters, it is unavoidable that the properties of the plating solution introduced from one end of the tube changes when the solution flows from the other end of the tube. Specifically, as a result of the reaction represented by the formula, $$Sn^{2+}+2Cu=Sn+2Cu^{+}$$

which occurs while the plating solution is circulated inside the copper tube, tin (II) ions are consumed and copper ions gradually accumulate, causing the quality of the tinned film to deteriorate on the side from which the plating solution flows. The longer the copper tube, the more remarkable this tendency. Therefore, control of the plating solution for tinning a long copper tube should be performed from a different viewpoint from the tinning process for a short copper tube.

A plating solution containing stannous sulfate and the like is circulated when substitution-type electroless tin plating is performed inside a long copper tube at a plating temperature usually of 60 to 70° C. If the temperature is 40° C. or lower, for instance, a thick plated film is produced only with difficulty due to a slow rate of deposition of the plating film material. In addition, the size of the deposited tin particles fluctuates, resulting in production of a number of pinholes. It is thus difficult to obtain a uniform plated film with sufficient corrosion resistance. However, deposition of plating film material is too fast when a long copper tube is tinned at a high temperature, resulting in accelerated consumption of tin (II) ions and accumulation of copper ions. This results in a decrease in the plated film thickness over the inner surface of copper tube, increase in the number of pinholes, and decrease in the adhesion strength of the film on the side from which the plating solution flows. Therefore, the maximum length of a copper tube which can be adequately tinned is about 200 m (9 $m^2$).

The number of pinholes in plated films can be reduced by simply increasing the film thickness to about 2 mm or more. Increasing the film thickness, however, is accompanied by an increase in the amount of tin (II) ion consumed from the plating solution. This involves an increase in the cost for chemicals. In addition, production of a thick film requires a longer plating time, also resulting in increased plating costs.

Coating tin inside a copper tube by electroplating rather than electroless tin plating may be one method for preventing formation of pinholes. Because electroplating produces tinned films with less pinholes, this method is effective in preventing pinhole production. However, to cover the whole length of copper tube with a uniform tin film by electroplating requires provision of a pair of electrodes in the tube. These electrodes must be installed so that no part thereof comes into contact with the tube wall. This is a difficult task to perform, particularly when the tube which is to be tinned is a small diameter coiled tube. Consequently, development of an electroless tin plating process with decreased pinhole production has been desired.

SUMMARY OF THE INVENTION

To overcome the above-mentioned problems in conventional processes for tinning a long copper tube, the present inventors have conducted extensive studies, wherein the properties of the plating solution introduced into and flowing out of the tube to be plated, and the relationships between the plating conditions and deposition of tin films onto the inner surface of the tube, have been studied on the substitution-type electroless tin plating process of a long copper tube which comprises circulating a plating solution in the tube.

An object of the present invention is therefore to provide a process for manufacturing a copper tube with a tinned internal surface which exhibits excellent adhesion properties and superior corrosion resistance such as pitted corrosion resistance and erosion resistance.

The achievement of the present invention is based on the development of an electroless plating solution producing only minimal pinholes without producing a thick plated film. Another object of the present invention is therefore to provide a process for manufacturing a copper tube of which the inner surface is covered with a tin-plated film with a minimal number of pinholes and exhibiting excellent adhesion properties.

To achieve the above-mentioned object, the present invention provides a process for manufacturing a copper tube with a tinned inner surface which comprises causing a substitution-type electroless tin plating solution to circulate inside the copper tube, wherein the process is characterized by comprising a first plating step wherein the rate of deposition of a tin film is adjusted so that the total copper ion concentration in the plating solution immediately after flowing from the copper tube after having been circulated inside the tube, divided by the tin (II) ion concentration in this plating solution is 0.8 or less, and a second plating step wherein the plating is carried out at a plating solution temperature higher than the plating solution temperature in the first plating step.

In the present invention, the composition of the electroless tin plating solution is set as follows to control formation of pinholes in the plated film, thereby ensuring manufacture of a high-performance inside-tinned copper tube.

(1) An electroless tin plating solution containing 0.05–0.3 mol/l of $Sn^{+2}$ ion, 0.5–2.0 mol/l of thiourea, 0.5–2.0 mol/l of sulfuric acid, 0.05–2.0 mol/l of alkyl benzene sulfonic acid, and 0.5–5.0 g/l of a nonionic surface active agent.

(2) An electroless tin plating solution containing, in addition to the components of electroless tin plating solution (1), 0.01–1.0 mol/l of a phosphoric acid compound and/or 0.05–1.0 mol/l of an organic carboxylic acid.

(3) The electroless tin plating solution (2) wherein the alkyl group of the alkyl benzene sulfonic acid has 1–6 carbon atoms.

(4) The electroless tin plating solution of (1), (2), or (3) wherein the HLB of the nonionic surface active agent is 10–15.

The copper tube which is the object to be plated by the process of the present invention is typically a phosphorus-deoxidized copper tube (JIS H3300 C1220) which is commonly used as a material for water supply tubes and hot water supply tubes. Copper tubes deoxidized using an deoxidation agent other than P, such as B, Mg, Si, or the like can also be used without impairing the effects of the present invention. In addition, high copper alloy tubes to which a very small amount of various elements such as Sn, Al, Zn, Mn, or Mg is added to increase corrosion resistance, strength, and the like, can also be used without any problem in the same manner as the phosphorus deoxidized copper tube, so long as the copper content is more than 96 wt %.

Other objects, features and advantages of the invention will hereinafter become more readily apparent from the following description.

DETAILED DESCRIPTION OF THE INVENTION AND PREFERRED EMBODIMENTS

In the present invention, a first plating step is carried out by adjusting the rate of deposition of a tin film so that the total copper ion concentration in the plating solution immediately after flowing from the copper tube after having been circulated inside the tube divided by the tin (II) ion concentration in this plating solution (total Cu ion concentration/$Sn^{2+}$ ion concentration) is 0.8 or less. When a plating solution is introduced from one end of a long copper tube and caused to flow out from the other end, thereby causing a plating reaction to proceed inside the tube to form a plated film, the value for (total Cu ion concentration/$Sn^{2+}$ ion concentration) in the plating solution maximizes when the circulated plating solution reaches the other end of the tube, so that if this latter value is controlled to 0.8 or less, the above-mentioned ratio of concentrations can be maintained at 0.8 or less throughout the whole length of the copper tube to be plated. This ensures formation of a uniform and excellent plated film over the total length of the copper tube. The less the value for (total Cu ion concentration/$Sn^{2+}$ ion concentration), the better the results. Thus, the value 0.6 or less is more preferred.

In the first plating treatment of the substitution-type electroless tin plating process of a long coil of copper tube of the present invention, when the plating solution is introduced from one end of the long copper tube at the time of initiation of plating and causing the plating solution to circulate inside the tube and flow from the other end, it is sufficient that the plating solution first emerging from the other end immediately after the operation has the value for (total Cu ion concentration/$Sn^{2+}$ ion concentration) of 0.8 or less, and preferably 0.6 or less.

It is important that the tinned film at the initial stage of plating be produced from the plating solution with the value for (total Cu ion concentration/$Sn^{2+}$ ion concentration) of 0.8 or less. The tinned film is then produced on this initial film as a nucleus, ultimately resulting in a tinned film with excellent quality. If the value for (total Cu ion concentration/$Sn^{2+}$ ion concentration) in the plating solution flowing out from the copper tube is greater than 0.8, the produced tinned film contains a large amount of Cu-Sn intermetallic compound, which impairs the quality of the tinned film, such as adhesion properties. Particularly, it is impossible to obtain tinned film with satisfactory quality if this concentration ratio for the plating solution at the initial step of plating is greater than 0.8, even if the ratio is afterward decreased to less than 0.8.

In carrying out the plating according to the process of the present invention, the coiled long copper tube to be plated is defatted, washed, and, as required, lightly etched in an acidic solution, followed by sufficient washing with water and drying. Then, a substitution-type electroless tin plating solution containing a tin (II) salt is introduced from one end of the copper tube to perform the first step plating while the solution is circulated inside the tube.

To adjust the rate of plating so that the total copper ion concentration in the plating solution, immediately after flowing from the copper tube after having been circulated inside the tube, divided by the tin (II) ion concentration in this plating solution is 0.8 or less, the plating temperature should be controlled at a relatively low temperature, preferably 20° C. to 60° C., and more preferably 20° C. to 40° C. By suppressing the plating temperature, the galvanizing reaction is controlled, so that deposition of Sn ions and elution of Cu ions in the circulated plating solution is controlled up to the exit side of the plating solution, which results in the formation of a superb initial plating film.

The lower the temperature of the plating solution in the first plating step, the smaller the ratio of (whole Cu ion concentration)/($Sn^{2+}$ ion concentration) in the plating solution on the exit side. If the temperature is lower than 20° C., however, precipitates tend to be produced in the plating solution; if higher than 60° C., on the other hand, the initial tinned film with excellent adhesion cannot be produced. The temperature of the plating solution in the first plating step should be adjusted according to the length of the plated copper tube. For example, it is possible to produce a superb initial tinned film inside a copper tube with an external diameter of 15.88 mm, a thickness of 0.71 mm, and a length of about 1000 m by controlling the temperature of the plating solution in the range of 20–40° C.

When circulation of a plating solution at a low temperature at which only a very small rate of Sn deposition is possible is continued for a long period of time, not only is the growth of tinned film very slow, requiring a long time to obtain a tinned film with a desired film thickness, but also the size of the deposited Sn particles tends to fluctuate and pinholes tend to be produced. This may result in the formation of a tinned film with only a poor corrosion resistance. To solve this problem, the process of the present invention combines a first plating step using a plating solution at a relatively low temperature and a second plating step wherein the plating solution is circulated at a temperature higher than the first plating step. This ensures faster growth of the tinned film in the second step on the initial film which has been formed in the first plating step.

The temperature of a plating solution in the second plating step is in the range of 60–80° C., and more preferably 60–70° C. As the method for heating the plating solution, a method of heating the plating bath by a suitable means, a method of heating the copper tube to increase the temperature of the circulating plating solution, and the like are given. The former method of heating the plating bath is more convenient, because the latter method of heating the copper tube may require an increase in the size of the facilities. It is desirable to perform the second plating step after the first plating step without any interim treatment such as washing or drying. Any treatment such as washing or drying after the first step may oxidize the plated tin film produced in the first step. This tends to retard growth of the plating film in the second step.

There are several methods for proceeding to the second plating step after completion of the first plating step. One method comprises heating the plating solution in the plating bath after completion of the first step plating operation for a prescribed period of time, then initiating the second plating step when the solution is heated to a specified temperature. Another method comprises continuously circulating the plating solution through the copper tube while raising the temperature of the plating solution in the plating bath after completion of the first step plating operation for a prescribed period of time, terminating heating when the plating solution is heated to some prescribed temperature, and then continuously circulating the plating solution to perform the second plating step. According to yet other method, the first step plating and the second step plating are continuously carried out without terminating circulation of the plating solution, but raising the temperature of the plating solution at the start of the first step and at a prescribed time after the start of the plating operation of the first step, thereby continuously proceeding to the second step. Furthermore, it is possible to provide a plating bath in which the plating solution is kept at a prescribed temperature and, after completion of the first step plating operation, this plating solution is circulated to the copper tube to carry out the second plating step.

Specific chemicals used for the plating solution and their optimum concentration range will now be explained. In addition to the basic chemicals, various chemical solutions may be added to the plating solution of the present invention to adjust its performance.

A. Tin (II) ion

It is desirable that the concentration of tin (II) ion ($Sn^{+2}$) is maintained in the range of 0.05 mol/l or more and less than 0.3 mol/l. If the concentration of the $Sn^{2+}$ ion is less than 0.05 mol/l or more than 0.3 mol/l, the resulting plated film has a great number of pinholes and cannot exhibit sufficient corrosion resistance.

As examples of sources of supply of tin (II) ion, stannous sulfate and stannous chloride are given.

B. Thiourea

Thiourea forms a complex with copper, the material on which the plating is produced, and this complex is involved in the substitution reaction of copper and tin. If the concentration of thiourea is low, a great number of pinholes may be produced on the plated film. The concentration should be 0.5 mol/l or more. Pinholes increase also when the concentration of thiourea is too high. Consequently, a suitable range of concentration of thiourea is 0.5–2.0 mol/l.

C. Sulfuric Acid

Sulfuric acid is commonly known to reduce the pH of the plating solution, to increase the solubility of the tin ion, and to maintain the tin ion in the divalent state. The present inventors have found that in addition to these effects, sulfuric acid has an effect of controlling production of pinholes in plated films and that this effect is exhibited in the concentration in the range of 0.5 mol/l to 2.0 mol/l. If the concentration of the sulfuric acid is too high, a high concentration of hydrogen sulfide gas is generated from the plating solution due to decomposition of thiourea, causing problems in the working environment. A desirable range of the sulfuric acidconcentrationis therefore 0.8 mol/l to 1.5 mol/l.

D. Alkylbenzene Sulfonic Acid

The present inventors have found that the presence of an aromatic sulfonic acid, particularly alkylbenzene sulfonic acid, in the plating solution in a concentration in the range of 0.05 to 2.0 mol/l is effective in reducing pinholes in the plated films. This effect is remarkable when an alkylbenzene sulfonic acid with an alkyl group having 1–6 carbon atoms and a comparatively hydrophobic nonionic surface active agent, for which examples are given below, are present together in the plating solution. Specific examples of useful alkylbenzene sulfonic acid include benzenesulfonic acid, toluenesulfonic acid, xylenesulfonic acid, and the like. Reduction in the number of pinholes is most remarkable when the concentration of these compounds is 0.2–0.5 mol/l. There is a conventionally known plating solution for electroless plating containing an aromatic sulfonic acid. In this case, the aromatic sulfonic acid is added as a stabilizer (a precipitation preventive) of $Sn^{2+}$ ions. The purpose of addition thus differs from that of the present invention.

E. Nonionic Surface Active Agent

Nonionic surface active agents are generally used as a luster for plated films. However, the studies of the present inventors have revealed that nonionic surface active agents are effective in reducing production of pinholes in plated films by the above-mentioned synergistic action with alkylbenzene sulfonic acid. Moreover, it was found that among nonionic surface active agents, those comparatively lypophilic nonionic surface active agents having an HLB value, representing a balance between the hydrophilic part and lypophilic part, of 15 or less (for example, polyoxyethylene nonyl phenyl ether or its derivatives) exhibit superior activity in controlling the formation of pinholes. However, because those having an HLB value of less than 10 are separated from the plating solution without being dissolved, the nonionic surface active agents with an HLB value of 10 or more can be used in practice.

HLB stands for "hydrophile-lypophile balance". Its vale numerically expresses the balance of the relative strength of the hydrophilic properties and lypophilic properties in the molecule of a surfactant. The HLB was experimentally produced by Mr. Griffin of the Atlas Company. The HLB of a compound can be experimentally calculated from the HLB value of the other compound for which the HLB is known. An approximate value of HLB for a compound can also be calculated from the chemical structure of the compound if the chemical structure is known. For example, an approximate value of the HLB for a compound with ethylene oxide for the hydrophilic part, such as polyoxyethylene alkyl ether and polyoxyethylene fatty acid ester, can be calculated from the equation, HLB=(wt % of ethylene oxide in the molecule)/5.

A sufficient effect can be obtained if the concentration of the nonionic surface active agent added is 0.5 g/l or more. On the other hand, no additional effects proportionate to the amount added can be expected and only an increase in cost may result if the concentration exceeds 5 g/l. Because of this, the amount of nonionic surface active agent to be added should be 5 g/l or less, and preferably 1–2 g/l. Nonipole™ (manufactured by Sanyo Chemical Industries, Ltd.), Emulgen™ (manufactured by Kao Corp.), Nonio™ (manufactured by Nippon Oil and Fats Co., Ltd.), and the like are given as examples of major nonionic surface active agents which can be used.

F. Organic Carboxylic Acid

Organic carboxylic acid is a complexing agent for the tin ion in the plating solution or the copper ion dissolved by the plating reaction, and has an action of stabilizing these ions in the plating solution. Although this effect is exhibited at a concentration of 0.05 mol/l or more, if the concentration is too large, pinholes are easily produced in the plated films. The concentration should therefore be in the range of 0.05 to 1.0 mol/l, and preferably 0.1 to 0.4 mol/l. Malonic acid, glycine, tartaric acid, citric acid, EDTA, and the like can be given as examples of the organic carboxylic acid. Of these, tartaric acid, citric acid, and EDTA are preferred due to ease in handling and strong complexing power with the tin ion and copper ion.

G. Phosphoric Acid Compound

A phosphoric acid compound has the effect of preventing oxidation of the tin ion and suppressing precipitation of the tin ion in solution. This effect is recognized at a concentration of 0.01 mol/l or more. The effect, however, is not simply proportionate to the concentration. If the concentration is increased, sulfides produced by the decomposition of thiourea tend to be precipitated in the plating solution. Because of this, the concentration should be adjusted to 1.0 mol/l or less. To ensure a continued effect, a preferable concentration range for the phosphoric acid compound is 0.1 to 0.5 mol/l. Hypophosphorous acid or the salt thereof can be used as the phosphoric acid compound Other features of the invention will become apparent in the course of the following description of the exemplary embodiments which are given for illustration of the invention and are not intended to be limiting thereof.

EXAMPLES

Example 1, Comparative Example 1

A phosphorus deoxidized copper plate with a thickness of 0.5 mm, a width of 20 mm, and a length of 80 mm was used as the material to be plated. The plate was washed in a chromium sulfuric acid solution (10% anhydrous chromic acid, 1% sulfuric acid), sufficiently washed with water, and dried. Plating solutions were prepared by adding copper ions (copper sulfate) to a commercially available substitution-type electroless tin plating solution (stannous salt 0.1 mol/l, organic sulfur compound 1 mol/l, organic carboxylate 0.1 mol/l, sulfuric acid 0.5 mol/l, aromatic sulfonate 0.2 mol/l, nonionic surfactant 1 g/l), and adjusting the ratio of the total Cu ion concentration/the $Sn^{2+}$ ion concentration in the plating solution as shown in Table 1. The copper plates were dipped in these plating solutions first to subject them to a first plating treatment at 30° C. for 30 minutes, and then to a second plating treatment by heating the plating solution to 70° C. for 60 minutes.

The plated thickness was measured, and adhesion properties and anti-erosion properties were evaluated on the resulting plated material (anti-corrosion evaluation 1). Measurement of the plated film thickness:

The plated sample was dissolved in a solution of hydrochloric acid (15 vol %) at 60° C. which contains a 3% aqueous solution of hydrogen peroxide (6 vol %), to measure the concentration of tin by atomic absorption spectrophotometry. The film thickness was calculated from the measured tin concentration, the density of tin, and the surface area of the sample.

Evaluation of Adhesion Properties:

The samples were subjected to a peeling test using a tape (Nitto No. 31B) to observe the absence or presence of peeling by the naked eye.

Anti-corrosion Evaluation 1:

A jet of tap water (flow rate: 10 m/s) from the Nagoya City waterworks, adjusted topH 6, was continuously flushed over the plated test pieces at right angles for five days to observe the production of corrosion. The diameter of the tap water injection port was 1.5 mm and the distance between the injection port and the plated film surface was 2 mm.

As is clear from the evaluation results shown in Table 1, the test pieces No. 1–5 of the present invention all exhibited superior adhesion properties and produced plated films with excellent corrosion resistance to a maximum corrosion depth of less than 0.05 mm. On the other hand, the tinned film of test pieces No. 6–8 treated in a solution with the ratio of the total Cu ion concentration/$Sn^{2+}$ ion concentration of 0.8 or more (the ion concentration in Table 1) exhibited only poor adhesion properties and produced corrosion with a maximum corrosion depth of 0.05 mm or more.

TABLE 1

| Tested material | Ion concentration | Plate thickness (mm) | Adhesion | Anti-corrosion evaluation 1 |
|---|---|---|---|---|
| 1 | 0 | 2.0 | ○ | ○ |
| 2 | 0.4 | 2.0 | ○ | ○ |
| 3 | 0.6 | 2.1 | ○ | ○ |
| 4 | 0.7 | 2.0 | ○ | Δ |
| 5 | 0.8 | 2.2 | ○ | Δ |
| 6 | 0.9 | 2.1 | x | x |
| 7 | 1.2 | 2.0 | x | x |
| 8 | 1.6 | 2.0 | x | x |

Adhesion:
○ No peeling in the plated film.
x The plated film peeled.
Anti-corrosion:
○ No corrosion.
Δ Maximum corrosion depth, 0.01–0.05 mm
x Maximum corrosion depth, more than 0.05 mm

Example 2

A coiled tube of phosphorus deoxidized copper with an external diameter of 15.88 mm, a tube thickness of 0.71 mm, and a length of 1000 m was used as the material to be plated. The inside of the tube was defatted using a commercially available defatting agent (containing 10% of amine compound, 9% of hydrochloric acid, and 5% of nonionic surfactants), subjected to soft etching using a mixed acid consisting of 13% sulfuric acid solution and 4% nitric acid solution, sufficiently washed, and dried. Then, a commercially available substitution-type electroless tin plating solution (stannous salt 0.1 mol/l, organic sulfur compound 1 mol/l, organic carboxylate 0.1 mol/l, surfuric acid 0.5 mol/l, aromatic sulfonate 0.2 mol/l, nonionic surfactant 1 g/l) was circulated inside the copper tube to treat under the first plating conditions and the second plating conditions shown in Table 2, wherein the second plating treatment was carried out continuously after the first plating step without terminating circulation of the plating solution, but raising the temperature of the solution in the plating bath to 70° C. at a heating rate of 1° C./min. The time from the completion of the temperature rise until termination of the plating treatment was deemed to be the period of the second step treatment.

TABLE 2

| Plated material | First plating treatment: Plating solution temp. (° C.) | First plating treatment: Plating time (min) | First plating treatment: Concentration ratio | Second plating treatment: Plating solution temp. (° C.) | Second plating treatment: Plating time (min) |
|---|---|---|---|---|---|
| 9 | 25 | 30 | 0.4 | 70 | 80 |
| 10 | 35 | 30 | 0.6 | 70 | 75 |
| 11 | 30 | 30 | 0.6 | 70 | 30 |

(Note) Concentration ratio: The ratio of the total Cu ion concentration/$Sn^{2+}$ ion concentration in the solution coming out of the tube.

The inside of the copper tube after the plated film was formed was washed with water and dried. Sample materials were collected from the parts of the tube one meter from the inlet port and from the outlet port of the plating solution. The plated thickness was measured, and adhesion properties and anti-erosion properties (anti-corrosion evaluation 1) were evaluated on the collected plated materials in the same manner as in Example 1. The pinhole density in the plated film was also measured.

Measurement of Pinhole Concentration:

The samples were dipped for 60 minutes at room temperature in a 2:1:4.7 mixed solution of aqueous ammonia 30%), ammonium persulphate, and ion exchanged water (which were prepared so as to achieve a dissolution rate of copper of 2 g/h and a dissolution rate of tin of 6 mg/h), to selectively dissolve the copper only in the part where there were pinholes in the plated film. The samples were washed and dried. The parts where the copper was dissolved and the adhesion strength s reduced were subjected to the peeling test using a tape itto No. B-31). The number of parts where the plated film was eled off (where copper was exposed) was counted by a microscope (×20).

TABLE 3

| Tested material | Part where the sample was taken | Plate thickness (mm) | Pinhole density (/cm$^2$) | Adhesion | Anti-corrosion evaluation 1 |
|---|---|---|---|---|---|
| 9 | *Plating solution inlet side | 2.2 | 0 | No peeling | No corrosion |
| | *Plating solution outlet side | 1.6 | 3 | No peeling | No corrosion |
| 10 | *Plating solution inlet side | 2.1 | 0 | No peeling | No corrosion |
| | *Plating solution outlet side | 1.7 | 20 | No peeling | No corrosion |
| 11 | *Plating solution inlet side | 2.1 | 0 | No peeling | No corrosion |
| | *Plating solution outlet side | 1.5 | 0 | No peeling | No corrosion |

As shown in Table 3, there have been no or almost no pinholes in the tinned films prepared on any tested materials on both the inlet side and outlet side of the plating solution. The tinned plate film exhibited excellent adhesion properties. In addition, these plating films have been confirmed to have superior corrosion resistance, with no corrosion whatsoever observed in the test.

Comparative Example 2

A phosphorus deoxidized copper tube with the same dimensions and qualities as those of the copper tube used in Example 2 was pretreated in the same manner as in Example 2 and plated using the same plating solution as in Example 2 under the conditions shown in Table 4. The plated film thickness, the pinhole density, adhesion properties, and anti-erosion characteristics (anti-corrosion evaluation 1) of the plated film were evaluated. The results are shown in Table 5.

TABLE 4

| Plated material | First plating treatment: Plating solution temp. (° C.) | First plating treatment: Plating time (min) | First plating treatment: Concentration ratio | Second plating treatment: Plating solution temp. (° C.) | Second plating treatment: Plating time (min) |
|---|---|---|---|---|---|
| 12 | 55 | 200 | 0.9 | — | — |
| 13 | 70 | 80 | 1.3 | — | — |
| 14 | 70 | 80 | 1.5 | — | — |

TABLE 5

| Tested material | Point where the sample was taken | Plate thickness (mm) | Pinhole density (/cm$^2$) | Adhesion | Anti-corrosion evaluation 1 |
|---|---|---|---|---|---|
| 12 | *Plating solution inlet side | 2.0 | 0 | No peeling | No corrosion |
| | *Plating solution outlet side | 1.6 | 2000 or more | Peeling | Erosion |

TABLE 5-continued

| Tested material | Point where the sample was taken | Plate thickness (mm) | Pinhole density (/cm$^2$) | Adhesion | Anti-corrosion evaluation 1 |
|---|---|---|---|---|---|
| 13 | *Plating solution inlet side | 2.2 | 0 | No peeling | No corrosion |
| | *Plating solution outlet side | 1.5 | 2000 or more | Peeling | Erosion |
| 14 | *Plating solution inlet side | 2.1 | 0 | No peeling | No corrosion |
| | *Plating solution outlet side | 1.5 | 2000 or more | Peeling | Erosion |

As can be seen in Table 5, because the tested materials No. 12 to No. 14 were treated with a plating solution at comparatively high temperatures in the first step, a great number of pinholes was produced in the plated films, especially on the outlet side of the plating solution, and the plated film exhibited poor adhesion and inferior corrosion resistance. Erosion was found in the corrosion test.

Example 3

A coiled tube of phosphorus deoxidized copper with an external diameter of 22.22 mm, a thickness of 0.81 mm, and a length of 1100 m was used as the material to be plated. The inside of the tube was washed with a mixed solution of 1% sulfuric acid solution and 5% anhydrous chromic acid solution, sufficiently washed with water, and dried. Then, a substitution-type electroless tin plating solution comprising stannous sulfate (0.2 mol/l), thiourea (1 mol/l), sodium hyposulfate (0.2 mol/l), sulfuric acid (1 mol/l), alkanol sulfonic acid (0.2 mol/l), nonionic and a nonionic surfactant (Emulgen™ 909, manufactured by Kao Corp., 1 g/l) was circulated inside the copper tube to treat under the plating conditions shown in Table 6.

TABLE 6

| | First plating treatment | | | Second plating treatment | |
|---|---|---|---|---|---|
| Plated material | Plating solution temp. (° C.) | Plating time (min) | Concen-tration ratio | Plating solution temp. (° C.) | Plating time (min) |
| 15 | 25 | 20 | 0.6 | 60 | 120 |
| 16 | 20 | — | 0.7 | 70 | — |

(Note) In the treatment of the plated material No. 16, the plating was started at a plating bath temperature of 20° C., then the temperature was raised to 70° C. at a heating rate of 0.5° C./min without terminating circulation of the plating solution. The plating treatment was continued until the plate thickness at the outflow end of the plating solution became 2 mm. The total time of plating treatment was 150 minutes.

After plating, the inside of the copper tube was washed with water and dried. Test pieces were collected from a point 1 m from the outflow end of the plating solution to measure the film thickness, adhesion properties, and pinhole density according to the same method as in the Example 2.

The tube of the tested material No. 10 was cut into a cylinder with a length of 10 cm and the cylinder was axially cut in half. The exterior copper exposed part was masked with an enamel resin. This test piece was subjected to a constant potential electrolysis at 200 mV vs SCE for 3 days in water simulating tap water from the Tokyo Metropolitan Waterworks to observe the production of corrosion on the copper, thereby evaluating pitted corrosion resistance (anti-corrosion evaluation 2). The results are shown in Table 7. As can be seen in Table 7, There were almost no pinholes observed in the tinned films on the tested material No. 15 and No. 16 of the present invention, indicating superior pitted corrosion resistance.

TABLE 7

| Tested material | Plate thickness (mm) | Pinhole density (/cm$^2$) | Adhesion | Anti-corrosion evaluation 2 |
|---|---|---|---|---|
| 15 | 1.3 | 10 | No peeling | No corrosion |
| 16 | 2.0 | 0 | No peeling | No corrosion |

Comparative Example 3

The same phosphorus deoxidized copper tube as used in the Example 3 was pretreated in the same manner as in Example 3 and plated using the same plating solution as in the Example 3 under the conditions shown in Table 8. The plated film thickness, pinhole density, adhesion properties, and anti-pitting characteristics (anti-corrosion evaluation 2) of the plated film were evaluated. The results are shown in Table 9.

TABLE 8

| | First plating treatment | | | Second plating treatment | |
|---|---|---|---|---|---|
| Plated material | Plating solution temp. (° C.) | Plating time (min) | Concen-tration ratio | Plating solution temp. (° C.) | Plating time (min) |
| 17 | 25 | 400 | 0.6 | — | — |
| 18 | 20 | 480 | 0.7 | — | — |

TABLE 9

| Tested material | Plate thickness (mm) | Pinhole density (/cm$^2$) | Adhesion | Anti-corrosion evaluation 2 |
|---|---|---|---|---|
| 17 | 1.3 | 2000 or more | Peeling produced | Pitting produced |
| 18 | 2.0 | 2000 or more | Peeling produced | Pitting produced |

As shown in Table 9, the tin plate films in the test material No. 17 and No. 18 produced by treating using a plating solution at a low temperature in the first step had a great number of pinholes and poor adhesion properties. Pitting was produced in the corrosion test.

Example 4, Comparative Example 4

Phosphorus deoxidized copper plates (80 mm×20 mm×0.5 mm) were used as the materials to be plated. After defatting and soft etching, the plates were dipped for 15 minutes in 1 l of substitution-type electroless tin plating solutions controlled to a temperature of 30° C., each having the composition shown in Table 10. The plating solution was then heated to 70° C., at which temperature tin plate films were produced for 30 minutes. The plated film thickness, pinhole density, anti-erosion characteristics (anti-corrosion evaluation 1), and anti-pitting characteristics (anti-corrosion evaluation 2) of the plated films were evaluated. The results are shown in Table 11. The anti-erosion characteristics (anti-corrosion evaluation 1) and the anti-pitting characteristics (anti-corrosion evaluation 2) were carried out under the following conditions.

<Anti-corrosion Evaluation 1>

NaCl was added to tap water from the Nagoya City waterworks to adjust the concentration of $Cl^-$ to 100 ppm. Then, the water was adjusted to 6 pH by the addition of potassium hydrogen phthalate. This water at a temperature controlled to 60° C. was continuously flushed over the surface of the test pieces at right angles at a flow rate of 10 m/s for 30 days. The diameter of the tap water injection port was 1.5 mm and the distance between the injection port and the surface of the test pieces was 2 mm. The results of the test are indicated by a symbol, either ○ where no corrosion was produced or X where corrosion was produced.

<Anti-corrosion Evaluation 2>

The corrosion resistance was evaluated by constant potential electrolysis. Specifically, the test piece was subjected to constant potential electrolysis at 200 mV vs SCE for 3 days in tap water from the Nagoya City waterworks. The results of the test are indicated by a symbol, either ○ where no corrosion was produced or X where corrosion was produced.

HLB value of the nonionic surfactants used are listed in Table 12

| <Basic composition> | |
|---|---|
| Stannous sulfate | 0.1 mol/l |
| Thiourea | 1.2 mol/l |
| Sulfuric acid | 0.9 mol/l |
| Sodium hypophosphate | 0.2 mol/l |
| Citric acid | 0.1 mol/l |
| Alkylbenzene sulfonic acid | 0.2 mol/l |
| Nonionic surfactant | 1 g/l |

TABLE 12

| Plating solution | Alkylbenzene sulfonic acid | Carbon atom content* | HLB value of nonionic surfactant |
|---|---|---|---|
| I | p-Touenesulfonic acid | 1 | 10.1 |
| J | p-Touenesulfonic acid | 1 | 12.4 |
| K | Sodium p-touenesulfonic acid | 1 | 12.4 |
| L | Sodium xylenesulfonic acid | 2 | 12.4 |
| M | Butylbenezenesulfonic acid | 3 | 12.4 |
| N | p-Touenesulfonic acid | 1 | 13.8 |
| O | p-Touenesulfonic acid | 1 | 14.5 |
| P | p-Touenesulfonic acid | 1 | 17.8 |
| Q | p-Touenesulfonic acid | 1 | 7.8 |

*The total carbon atom content in the side chain of the benzene ring.

The plating solutions were circulated through a coiled tube of phosphorus deoxidized copper with an external diameter of 15.88 mm, a thickness of 0.71 mm, and a length of 1000 m to perform the first and second plating treatments under the conditions shown in Table 13.

TABLE 10

| Plating solution | Plating solution composition (mol/l) | | | | | | |
|---|---|---|---|---|---|---|---|
| | Stannous sulfate | Thiourea | Sulfuric acid | p-Toluene sulfonic acid | Nonionic surfactant* | Tartaric acid | Sodium hypophosphate |
| A | 0.07 | 0.7 | 1.0 | 0.2 | 1.0 | 0.2 | 0.2 |
| B | 0.1 | 1.0 | 1.0 | 0.2 | 1.0 | 0.2 | 0.2 |
| C | 0.2 | 1.5 | 1.8 | 0.4 | 2.0 | 0.2 | 0.2 |
| D | 0.1 | 1.5 | 1.2 | 0.1 | 0.5 | 0.1 | 0.1 |
| E | 0.15 | 1.0 | 0.8 | 1.0 | 4.0 | 0.06 | 1.0 |
| F | 0.1 | 2.0 | 1.0 | 1.8 | 5.0 | 0.9 | 0.5 |
| G | 0.1 | 1.0 | 1.0 | 0.2 | 1.0 | 0.07 | 0.03 |
| H | 0.1 | — | 0.5 | 0.2 | 1.0 | 0.2 | — |

(Note 1) *Nonionic surfactant (g/l), polyoxyethylene nonylphenyl ether with an HLB value of 12.4.
(Note 2) Copper sulfate was added to all plating solutions to adjust the ratio of the total Cu ion concentration/$Sn^{2+}$ ion concentration to 0.4–0.6.

TABLE 11

| Plating material | Plating solution | Plating film thickness (mm) | Pinhole density (/cm$^2$) | Anti-corrosion evaluation 1 | Anti-corrosion evaluation 2 |
|---|---|---|---|---|---|
| 19 | A | 1.1 | 20 | ○ | ○ |
| 20 | B | 1.0 | 35 | ○ | ○ |
| 21 | C | 0.9 | 5 | ○ | ○ |
| 22 | D | 0.8 | 100 | ○ | ○ |
| 23 | E | 1.0 | 50 | ○ | ○ |
| 24 | F | 1.0 | 250 | ○ | ○ |
| 25 | G | 0.8 | 75 | ○ | ○ |
| 26 | H | 1.0 | 700 | x | ○ |

Example 5, Comparative Example 5

Plating solutions with the following basic composition were prepared. The alkylbenzene sulfonic acids and the

TABLE 13

| Plated material | Plating solution | First plating treatment: Plating solution temp. (° C.) | First plating treatment: Plating time (min) | First plating treatment: Concentration ratio | Second plating treatment: Plating solution temp. (° C.) | Second plating treatment: Plating time (min) |
|---|---|---|---|---|---|---|
| 27 | I | 25 | 30 | 0.4 | 70 | 60 |
| 28 | J | 35 | 30 | 0.6 | 70 | 60 |
| 29 | K | 25 | 30 | 0.4 | 70 | 60 |
| 30 | L | 35 | 30 | 0.6 | 70 | 60 |
| 31 | M | 25 | 30 | 0.4 | 70 | 60 |
| 32 | N | 35 | 30 | 0.6 | 70 | 60 |
| 33 | O | 25 | 30 | 0.4 | 70 | 60 |
| 34 | P | 25 | 30 | 0.4 | 70 | 60 |
| 35 | Q | 35 | 30 | 0.4 | 70 | 60 |

The tin plated tubes were cut into cylinders, each having th of 80 mm, and the cylinders were axially cut in half. masking the exterior copper exposed part with silicone, ated film thickness and pinhole density were measured. ition, the anti-erosion characteristics (anti-corrosion ation 1) and anti-pitting characteristics (anti-corrosion evaluation 2) were evaluated in the same manner as in Example 4. The results are shown in Table 14.

TABLE 14

| Plating material | Point where the sample was taken | Plating film thickness (mm) | Pinhole density (/cm$^2$) | Anti-corrosion evaluation 1 | Anti-corrosion evaluation 2 |
|---|---|---|---|---|---|
| 27 | *Plating solution inlet side | 2.2 | 10 | ○ | ○ |
| | *Plating solution outlet side | 1.6 | <1 | ○ | ○ |
| 28 | *Plating solution inlet side | 2.2 | <1 | ○ | ○ |
| | *Plating solution outlet side | 1.5 | 30 | ○ | ○ |
| 29 | *Plating solution inlet side | 2.3 | <1 | ○ | ○ |
| | *Plating solution outlet side | 1.7 | 20 | ○ | ○ |
| 30 | *Plating solution inlet side | 2.1 | <1 | ○ | ○ |
| | *Plating solution outlet side | 1.6 | 20 | ○ | ○ |
| 31 | *Plating solution inlet side | 2.1 | <1 | ○ | ○ |
| | *Plating solution outlet side | 1.6 | 10 | ○ | ○ |
| 32 | *Plating solution inlet side | 2.2 | <1 | ○ | ○ |
| | *Plating solution outlet side | 1.5 | 20 | ○ | ○ |
| 33 | *Plating solution inlet side | 2.2 | 2 | ○ | ○ |
| | *Plating solution outlet side | 1.7 | 30 | ○ | ○ |
| 34 | *Plating solution inlet side | 2.2 | 100 | x | ○ |
| | *Plating solution outlet side | 1.7 | 500 | x | ○ |
| 35 | *Plating solution inlet side | 2.2 | 200 | x | x |
| | *Plating solution outlet side | 1.6 | 800 | x | x |

As described above, the process of the present invention can plate the inside of a long copper tube with a tin film possessing a uniform thickness, having almost no pinholes, exhibiting superior adhesion properties, and producing almost no erosion or pitting.

What is claimed is:

1. In a process for manufacturing a coiled long copper tube with a tinned inner surface which comprises causing an electroless tin plating solution to circulate inside the copper tube and tin plating to occur inside the tube by electroless plating, the improvement comprising said process comprising conducting a first plating step at a temperature of from 20–40° C. and adjusting the rate of deposition of a tin film so that the total copper ion concentration in the plating solution immediately after flowing from the copper tube after having been circulated inside the tube, divided by the tin (II) ion concentration in this plating solution is 0.8 or less, and conducting a second plating step wherein plating is carried out at a plating solution temperature of from 60–80° C.

2. The process according to claim 1, wherein the first plating step and the second plating step are continuously carried out without terminating circulation of the plating solution, while continuously raising the temperature of the plating solution.

3. The process according to claim 1, wherein an electroless tin plating solution is circulated inside the copper tube in the first and second plating steps and comprises 0.05–0.3 mol/l of $Sn^{+2}$ ion, 0.5–2.0 mol/l of thiourea, 0.5–2.0 mol/l of sulfuric acid, 0.05–2.0 mol/l of alkyl benzene sulfonic acid, and 0.5–5.0 g/l of a nonionic surface active agent.

4. The process according to claim 3, wherein the electroless tin plating solution further comprises at least one member selected from the group consisting of 0.01–1.0 mol/l of a phosphoric acid compound and 0.05–1.0 mol/l of an organic carboxylic acid.

5. The process according to claim 3, wherein the alkyl group of the alkyl benzene sulfonic acid has 1–6 carbon atoms.

6. The process according to claim 3, wherein the nonionic surface active agent in the electroless tin plating solution has an hydrophilic-lipophilic balance value of 10–15.

7. In a process for manufacturing a copper tube with a tin layer provided on an inner surface thereof by circulating an electroless tin plating solution inside the copper tube and forming the tin layer on the inner surface of the copper tube by electroless plating, the improvement comprising said process comprising a first plating step of circulating the electroless tin plating solution through the copper tube at a temperature of from 20–40° C. while controlling the rate of deposition of tin from the plating solution so that the total copper ion concentration divided by the tin (II) ion concentration in the plating solution immediately after exiting the copper tube is no greater than 0.8 and a second plating step of circulating the electroless tin plating solution through the copper tube at a higher temperature than in the first plating step and at a temperature of from 60–80° C.

8. The process according to claim 7, wherein said copper tube is a phosphorus-deoxidized copper tube.

9. The process according to claim 7, wherein the temperature of the plating solution during the second plating step is from 60–70° C.

* * * * *

UNITED STATES PATENT AND TRADEMARK OFFICE

CERTIFICATE OF CORRECTION

PATENT NO. : 6,045,860
DATED : April 4, 2000
INVENTOR(S) : Junichi Ito et al.

It is certified that error appears in the above-identified patent and that said Letters Patent is hereby corrected as shown below:

Tables 1, 3, 5, 7, 9, 11 and 14,
Change Plate thickness "(mm)" to Plate thickness -- (μm) --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*